US009668061B2

(12) United States Patent
Akino

(10) Patent No.: US 9,668,061 B2
(45) Date of Patent: May 30, 2017

(54) ELECTRODYNAMIC ACOUSTIC TRANSDUCER, CONDENSER MICROPHONE AND CONDENSER HEADPHONES

(71) Applicant: KABUSHIKI KAISHA AUDIO-TECHNICA, Machida-shi, Tokyo (JP)

(72) Inventor: Hiroshi Akino, Machida (JP)

(73) Assignee: KABUSHIKI KAISHA AUDIO-TECHNICA, Machida-Shi, Tokyo (JP)

( * ) Notice: Subject to any disclaimer, the term of this patent is extended or adjusted under 35 U.S.C. 154(b) by 3 days.

(21) Appl. No.: 14/312,002

(22) Filed: Jun. 23, 2014

(65) Prior Publication Data

US 2015/0098592 A1 Apr. 9, 2015

(30) Foreign Application Priority Data

Oct. 3, 2013 (JP) ..... 2013-208155

(51) Int. Cl.

| | |
|---|---|
| ***H04R 25/00*** | (2006.01) |
| ***H04R 19/01*** | (2006.01) |
| *H04R 31/00* | (2006.01) |
| *H04R 1/10* | (2006.01) |
| *H04R 7/00* | (2006.01) |

(52) U.S. Cl.

CPC ..... *H04R 19/01* (2013.01); *H04R 19/016* (2013.01); *H04R 1/10* (2013.01); *H04R 7/00* (2013.01); *H04R 19/013* (2013.01); *H04R 31/00* (2013.01); *Y10T 29/49005* (2015.01)

(58) Field of Classification Search

CPC ..... H04R 19/01; H04R 19/016; H04R 1/10; H04R 7/00; H04R 19/013; H04R 31/00; Y10T 29/49005

USPC ..... 381/174

See application file for complete search history.

(56) References Cited

U.S. PATENT DOCUMENTS

| | | | | |
|---|---|---|---|---|
| 4,527,218 A * | 7/1985 | von Seggern | ..... | H01G 7/023 29/886 |
| 2009/0296963 A1* | 12/2009 | Akino | ..... | H04R 7/14 381/174 |
| 2010/0322439 A1* | 12/2010 | Akino | ..... | H04R 19/04 381/111 |

FOREIGN PATENT DOCUMENTS

| | | |
|---|---|---|
| JP | 2003-153395 A | 5/2003 |
| JP | 2005-045410 A | 2/2005 |

* cited by examiner

*Primary Examiner* — Duc Nguyen
*Assistant Examiner* — Sean H Nguyen
(74) *Attorney, Agent, or Firm* — Manabu Kanesaka

(57) ABSTRACT

In an electrodynamic acoustic transducer which uses a surface potential of an electret dielectric film as a polarization voltage, prevention of partial suctional adhesion of a diaphragm caused by variation in surface potential across the electret dielectric film is ensured in a simple way. In an electrodynamic acoustic transducer including a diaphragm and a fixed pole which are arranged with a predetermined interval so as to face each other, a facing surface of either one of the diaphragm and the fixed pole having an electret dielectric film, a surface of the electret dielectric film is divided into a plurality of segment regions, and a predetermined surface potential is given to each of the segment regions by a polarization processing unit.

8 Claims, 3 Drawing Sheets

ELECTRODYNAMIC ACOUSTIC TRANSDUCER, CONDENSER MICROPHONE AND CONDENSER HEADPHONES

CROSS-REFERENCE TO RELATED APPLICATION

The present application is based on, and claims priority from, Japanese Application Serial Number JP2013-208155, filed Oct. 3, 2013, the disclosure of which is hereby incorporated by reference herein in its entirety.

TECHNICAL FIELD

The present invention relates to an electrodynamic acoustic transducer which uses the surface potential of an electret dielectric film as a polarization voltage and, more particularly, to a technique for preventing partial suctional adhesion of a diaphragm caused by variation in surface potential across an electret dielectric film.

BACKGROUND ART

Acousto-electric and electro-acoustic transducers using an electret dielectric film (hereinafter also simply referred to as an "electret") include a condenser microphone and condenser headphones. These transducers use the surface potential of an electret as a polarization voltage and need no polarization power source, such as a DC/DC converter. The transducers are advantageous in that the circuit configuration can he simplified.

Examples of an electret material include FEP (a copolymer of tetrafluoroethylene and hexafluoropropylene) and $SiO_2$. An electret material has the property of being polarized when a high DC voltage is applied and retaining polarization after the voltage is removed.

Negative corona discharge is generally used for polarization processing (electretization processing). Scorotron having a control grid or the like is used to reduce partial variation in surface potential across an electret. An electret varies partially in surface potential due to the surface state, the charge condition, and the like of an electret material.

In the case of a directional condenser microphone, the tension of a diaphragm is designed to be low to secure a bass frequency response. The diaphragm is thus likely to be made to adhere suctionally to a fixed pole. When stability to suctional adhesion is underrun, the diaphragm adheres suctionally to the fixed pole by electrostatic suction force.

In view of this, stability μ to suctional adhesion is set in the design of a microphone so as to prevent suctional adhesion of a diaphragm by the above-described electrostatic suction force from occurring depending on storage environment or use environment. The stability μ to suctional adhesion is represented by the following expression:

$$\mu = A \times s_0 \times (db^3/Eb^2)$$

(where A is a proportionality constant including vacuum permittivity, the effective area of a diaphragm, and the distance between the diaphragm and a fixed pole, $s_0$ is the stiffness of the diaphragm, db is the interelectrode distance between the diaphragm and the fixed pole, and Eb is the surface potential (polarization voltage) of the fixed pole).

The stiffness so of the diaphragm and the interelectrode distance db are determined according to a directional frequency response required for a product. It is thus possible to fabricate a directional condenser microphone having a good directional frequency response and high sensitivity by maximizing the polarization voltage Eb within a range which prevents suctional adhesion of the diaphragm to the fixed pole.

When a polarization voltage reaches a suctional adhesion limit in a condenser microphone in which the polarization voltage is applied to a fixed pole by a DC/DC converter or the like, if a diaphragm is a circular film, a central portion thereof is made to adhere suctionally to the fixed pole first. A suctional adhesion area increases toward a peripheral portion with increase in the polarization voltage.

In contrast, if an electret is used, since there is variation in surface potential across the electret, as described above, a portion which is made to adhere suctionally first is not always a central portion. When the electret has a surface potential close to a suctional adhesion limit, variation in surface potential across the electret causes local and partial suctional adhesion.

If the surface potential of an electret is heightened to exceed a suctional adhesion limit, a phenomenon occurs in which the suctional adhesion area spreads gradually. More specifically, suctional adhesion occurs at a portion with a second highest surface potential which is adjacent to a portion as a center that is made to adhere suctionally first. If the first partial suctional adhesion is prevented, the effective surface potential of the electret is kept high, which makes sensitivity higher.

In order to prevent suctional adhesion of a diaphragm to a fixed pole, Patent Document 1 (Japanese Patent Application Publication No. 2003-153395) proposes the idea of making the surface potential of a central portion of a fixed pole lower than that of a peripheral portion. Patent Document 2 (Japanese Patent Application Publication No. 2005-045410) proposes the idea of making a central portion of a fixed pole into an electret-less region.

However, neither Patent Document 1 nor 2 is effective against local and partial suctional adhesion in a portion other than a central portion caused by variation in surface potential across an electret. In Patent Document 1, a central portion and a peripheral portion of a fixed pole are different in surface potential, and polarization processing of an electret is performed in two steps with different corona discharge voltages for the central portion and the peripheral portion of the fixed pole. This leads to low productivity.

Under the circumstances, an object of the present invention is to ensure prevention of partial suctional adhesion of a diaphragm caused by variation in surface potential across an electret dielectric film in a simple way in an electrodynamic acoustic transducer using the surface potential of the electret dielectric film as a polarization voltage.

SUMMARY OF THE INVENTION

In order to attain the above-described object, according to the present invention, there is provided an electrodynamic acoustic transducer including a diaphragm and a fixed pole which are arranged with a predetermined interval so as to face each other, a facing surface of either one of the diaphragm and the fixed pole having an electret dielectric film, wherein a surface of the electret dielectric film is divided into a plurality of segment regions, and a predetermined surface potential is given to each of the segment regions by polarization processing means.

According to the present invention, the electret dielectric film is divided into a plurality of segment regions. The diaphragm includes a plurality of sub-vibration regions small in area and in the amount of displacement accordingly, which are obtained through spurious partition so as to face the respective segment regions. An electrostatic suction force acts on each sub-vibration region. For this reason, even if there is variation in surface potential across the electret dielectric film, the diaphragm is not distorted and drawn toward a high-potential portion. The entire diaphragm remains substantially planar from a macroscopic point of view, and there is little possibility of partial suctional adhesion of the diaphragm to the fixed pole.

According to the present invention, Sb<Sa holds where Sa is the area of a maximum surface potential region in which a surface potential of the above-described electret dielectric film is the highest, and Sb is the area of the above-described segment region.

Since the area Sb of each segment region is made smaller than the area Sa of the maximum surface potential region (Sb<Sa), an area Sc (≈Sb) of each sub-vibration region of the diaphragm is smaller than the area Sa of the maximum surface potential region accordingly. This prevents first partial suctional adhesion of the diaphragm in the maximum surface potential region. An effective surface potential of an electret is thus kept high. In the case of a condenser microphone, sensitivity can be made higher.

The above-described electret dielectric film may be arranged on the fixed pole side. The electrodynamic acoustic transducer according to the present invention is preferably of the back electret type, in which the above-described electret dielectric film is arranged on the above-described fixed pole side.

The present invention also includes a condenser microphone including the above-described electrodynamic acoustic transducer and condenser headphones including the above-described electrodynamic acoustic transducer.

The present invention further includes two first and second manufacturing methods for manufacturing a fixed pole having an electret dielectric film on a surface facing a diaphragm. In the first manufacturing method, the above-described electret dielectric film is subjected to polarization processing through corona discharge with a metal mask whose surface is divided into a plurality of segment regions arranged on the above-described electret dielectric film and the above-described metal mask and the above-described fixed pole grounded, and a predetermined surface potential is given to each of the above-described segment regions.

In the second manufacturing method, the above-described electret dielectric film is thoroughly subjected to polarization processing through corona discharge, and a charged surface of the above-described electret dielectric film is then divided into a plurality of segment regions through elimination of static electricity from the charged surface with alcohol.

In the manufacturing methods according to the present invention, the segment regions of the electret dielectric film may be simultaneously subjected to polarization processing through corona discharge. It is unnecessary to intentionally give different surface potentials to the segment regions. This allows efficient manufacture of a fixed pole having an electret dielectric film.

DETAILED DESCRIPTION

An embodiment of the present invention will be described with reference to FIGS. 1 to 7. The present invention, however, is not limited to this.

Figure 1:
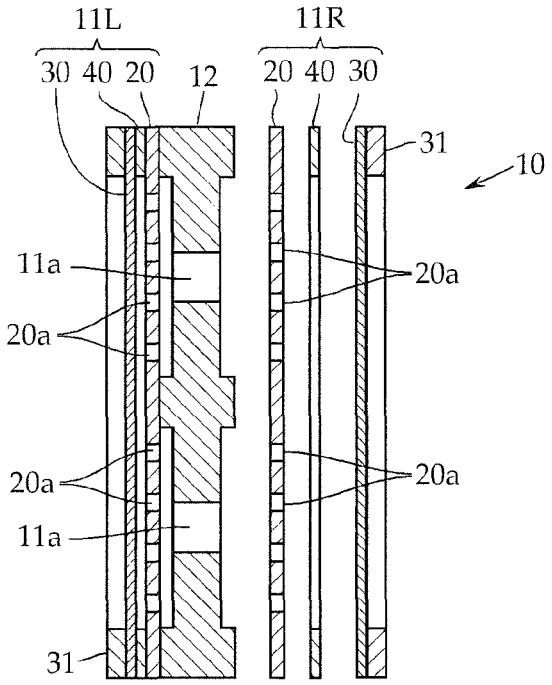
FIG. 1 is a cross-sectional view showing an electrodynamic acoustic transducer according to one embodiment of the present invention.

Referring first to FIG. 1, an electrodynamic acoustic transducer 10 according to the embodiment is an electrostatic transducer which is designed for a bidirectional condenser microphone and includes an insulation seat 12 which is made of synthetic resin and is disk-shaped and one pair of condenser units 11L and 11R which are arranged on two sides of the insulation seat 12. Although the condenser unit 11R on the right side is shown in exploded view in FIG. 1, the condenser units 11L and 11R have the same configurations.

The condenser units 11L and 11R both include a fixed pole 20 and a diaphragm 30 which is arranged so as to face the fixed pole 20 across an electrically insulating spacer ring 40. The diaphragm 30 is made up of a thin film of a synthetic resin, such as PET (polyethylene terephthalate), and is provided at a diaphragm ring 31 with a predetermined tension.

Continuous holes 11*a* for acoustically connecting the condenser units 11L and 11R are formed in the insulation seat 12. Sound holes (holes through which sound passes) 20*a* are formed in the fixed pole 20. The numbers of continuous holes 11*a* and sound holes 20*a* may be arbitrarily determined.

Figure 2A:
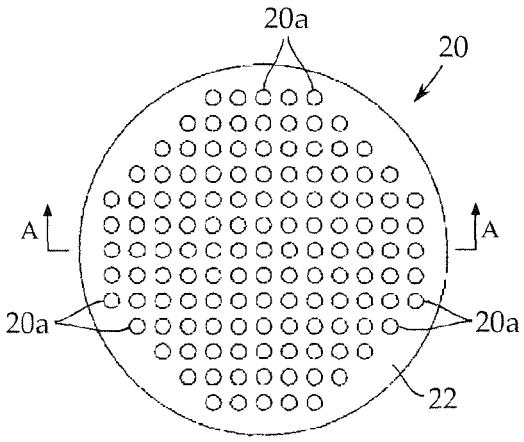
FIG. 2A is a plan view of a fixed pole included in the above-described electrodynamic acoustic transducer.
Figure 2B:
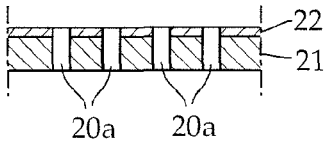
FIG. 2B is a partially enlarged cross-sectional view taken along line A-A in FIG. 2A.

The electrodynamic acoustic transducer 10 according to this embodiment is of the back electret type. As shown in FIGS. 2A and 2B, the fixed pole 20 integrally includes an electret dielectric film 22 on the side with a surface facing the diaphragm 30 of a metal electrode plate 21.

FEP (a copolymer of tetrafluoroethylene and hexafluoropropylene), $SiO_2$, or the like is used in the electret dielectric film 22. Corona discharge is generally used for polarization processing of the electret dielectric film 22 (electretization processing). Partial variation in surface potential across an electret occurs depending on the surface state, the charge condition, and the like of an electret material.

When the surface potential of an electret is locally high and exceeds a limit for suctional adhesion to a diaphragm, a phenomenon occurs in which a suctional adhesion area spreads gradually from one point to another. More specifically, suctional adhesion starts from a high-potential portion, and suctional adhesion occurs at a portion with a second highest surface potential adjacent to the high-potential portion.

Thus, inhibition of partial suctional adhesion which occurs first at a portion with a highest surface potential (a maximum surface potential region) is important in maintaining the performance of the electrodynamic acoustic transducer 10. As described earlier, a maximum surface potential region 22A, however, do not always appear at a central portion of the fixed pole 20.

Figure 3:
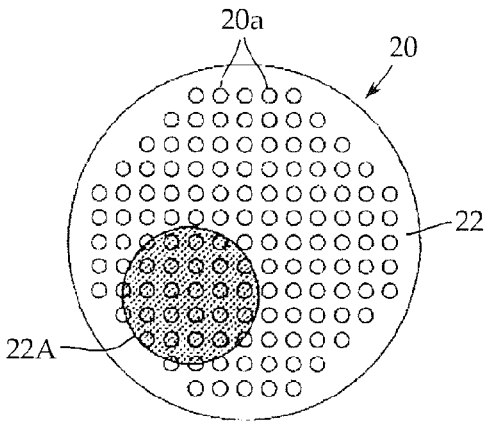
FIG. 3 is a schematic view showing a maximum surface potential region which arises from variation in surface potential across an electret dielectric film.

As an example, a state is shown in FIG. 3 in which the maximum surface potential region 22A with a surface potential highest among surface potentials given to the electret dielectric film 22 through polarization processing appears on one side to stretch from the central portion of the fixed pole 20 to a peripheral portion.

Note that partial charge of an electret dielectric film and the area of the partial charge can be measured through, for example, the method for measuring the surface voltage of an electret dielectric film disclosed in Japanese Patent No. 4663532 (Japanese Patent Application Publication No. 2007-194774).

Figure 6A:
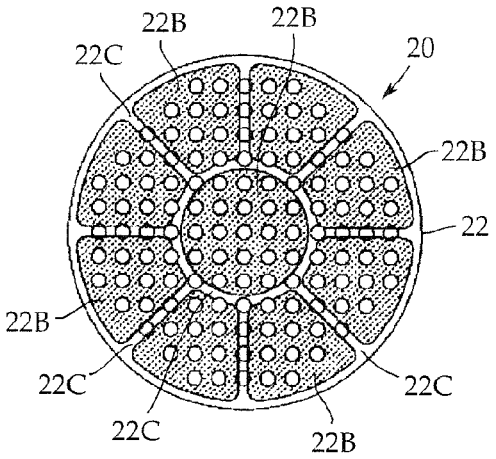
FIG. 6A is a plan view showing the fixed pole having segment regions subjected to polarization processing.

As described above, it is unknown at which portion of the fixed pole 20 the maximum surface potential region 22A with the highest surface potential appears. For this reason, in the present invention, a surface of the electret dielectric film 22 is divided into a plurality of segment regions 22B, as shown in FIG. 6A.

Figure 4:
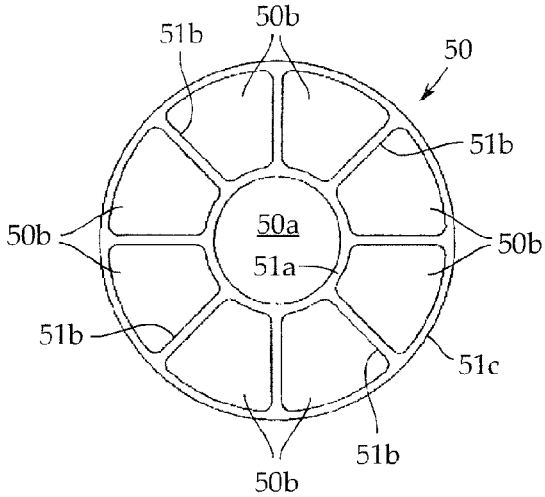
FIG. 4 is a plan view showing an example of a metal mask for segment region formation.

In this embodiment, the surface of the electret dielectric film 22 is divided into the segment regions 22B using a metal mask 50 as shown in FIG. 4.

In this embodiment, the metal mask 50 is formed by stamping, through press working, a metal plate of, e.g., aluminum having a thickness of 0.1 to 0.5 mm into a spoke wheel shape having a circular blank portion 50*a* at the center and eight fan-like trapezoidal blank portions 50*b* around the blank portion 50*a*. The outer diameter of the metal mask 50 is preferably equal to the diameter of the electret dielectric film 22.

Figure 5:
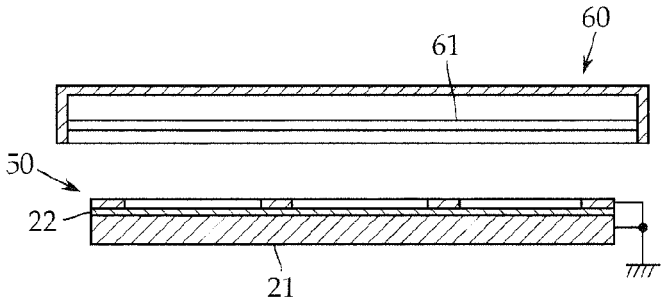
FIG. 5 is a schematic view showing a state in which the electret dielectric film is subjected to polarization processing through corona discharge using the above-described metal mask.

At the time of polarization of the electret dielectric film 22 (electretization), as shown in FIG. 5, the metal mask 50 is arranged on the electret dielectric film 22 so as to be in close contact, and a high DC voltage is applied by a negative corona discharge device 60 having a discharge wire 61 with the metal mask 50 and the metal electrode plate 21 grounded.

With this application, respective portions of the electret dielectric film 22 corresponding to the blank portions 50*a* and 50*b* of the metal mask 50 become the segment regions 22B that are negatively charged, as shown in FIG. 6A.

Figure 6B:
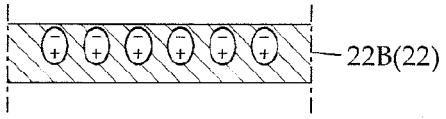
FIG. 6B is an enlarged cross-sectional view showing a state in which dipoles are oriented in each segment region.

That is, the above-described polarization processing orient dipoles present in each segment region 22B such that the minus sides are arranged along the surface of the electret dielectric film 22, as shown in FIG. 6B. A predetermined negative surface potential is thus given to each segment region 22B.

Note that regions (portions between the segment regions 22B and a marginal portion of the electret dielectric film 22) covered by a hub portion 51*a*, spoke portions 51*b*, and a rim portion 51*c* which the metal mask 50 shown in FIG. 4 includes as a skeleton are left as non-charged regions (non-polarized regions) 22C which are not polarized.

Figure 7:
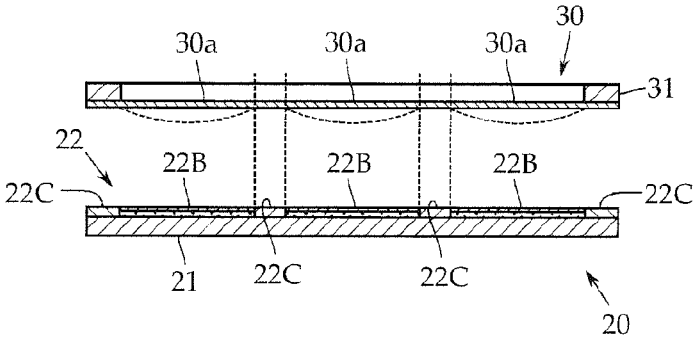
FIG. 7 is a schematic cross-sectional view for explaining the action of the present invention with the fixed pole and a diaphragm facing each other.

A state in which the diaphragm 30 is made to face the fixed pole 20 is shown in FIG. 7. Since the electret dielectric film 22 is divided into the plurality of segment regions 22B in the present invention, an effective vibration region (an entire main vibration region surrounded by the diaphragm ring 31) of the diaphragm 30 includes a plurality of sub-vibration regions 30*a* which are obtained through spurious partition so as to face the respective segment regions 22B.

The sub-vibration region 30*a* is smaller in area than the effective vibration region (the entire main vibration region) of the diaphragm 30. As indicated by chain lines in FIG. 7, the amount of displacement is smaller than in a case where the entire surface of the diaphragm 30 is electrostatically sucked.

Additionally, an electrostatic suction force from each divided electret dielectric film 22 acts on the corresponding sub-vibration region 30*a*. Even if there is variation in surface potential across the electret dielectric film 22, the diaphragm 30 is not distorted and drawn toward a high-potential portion. The entire diaphragm remains substantially planar from a macroscopic point of view, and there is little possibility of partial suctional adhesion of the diaphragm 30 to the fixed pole 20.

In a preferred embodiment of the present invention, the electret dielectric film 22 is divided such that $Sb<Sa$ holds where Sa is the area of the maximum surface potential region 22A and Sb is the area of each segment region 22B.

The area Sa of the maximum surface potential region 22A in this case may be a value calculated from an empirical value or a predicted value. The areas Sb of the segment regions 22B are preferably substantially equal (substantially identical) but may be unequal.

According to this configuration, an area Sc ($\approx Sb$) of each sub-vibration region 30*a* of the diaphragm 30 is smaller than the area Sa of the maximum surface potential region 22A. This allows prevention of first partial suctional adhesion of the diaphragm 30 in the maximum surface potential region 22A.

The electret dielectric film 22 is divided into nine segment regions 22B in the above-described embodiment. The present invention includes a case where the electret dielectric film 22 is divided into two or more parts. The division may be either equal division or unequal division, and the electret dielectric film 22 may be concentrically divided.

The electret dielectric film 22 is divided into a plurality of segment regions using the metal mask 50 at the time of polarization processing in the embodiment. Alternatively, the electret dielectric film 22 can be thoroughly subjected to polarization processing through corona discharge, and the charged surface of the electret dielectric film 22 can then be divided into a plurality of segment regions through elimination of static electricity from the charged surface with alcohol.

As an example, flocks which are short-fibered and absorbable are provided at the hub portion 51*a*, the spoke portions 51*b*, and the rim portion 51*c* of the metal mask 50 in the spoke wheel shape through, for example, electrostatic flocking, the flocks are soaked in alcohol, and the metal mask 50 is arranged on the polarized electret dielectric film 22. Even in this way, the electret dielectric film 22 can be divided into a plurality of segment regions in the same manner as shown in FIG. 6A.

The electrodynamic acoustic transducer 10 according to the above-described embodiment is designed for a bidirectional condenser microphone having the one pair of condenser units 11L and 11R. An electrodynamic acoustic transducer according to the present invention, however, is not limited to an acousto-electric transducer, such as a unidirectional condenser microphone having a condenser unit only on one side or an omnidirectional condenser microphone without specific directivity and may be applied to condenser headphones as an electro-acoustic transducer. The electrodynamic acoustic transducer may be of the membrane electret type that has an electret dielectric film on the diaphragm side.

The invention claimed is:

1. An electrodynamic acoustic transducer comprising:

a diaphragm; and a fixed pole which is arranged with a predetermined interval from the diaphragm and faces the diaphragm, and which has an electret dielectric film on a surface facing the diaphragm, the electret dielectric film being divided into a plurality of segment regions, and each of the plurality of segment regions having a predetermined surface potential given by a polarization processing, wherein the fixed pole further includes non-polarized regions for separating the segment regions so that the segment regions are separated from each other, wherein the plurality of segment regions includes a center region and circumference regions radially arranged around the center region, which are separated by the non-polarized regions, and wherein the electret dielectric film is a flat film separated into the segment regions, wherein the segment regions are negatively charged, and wherein the non-polarized regions separate the segment regions.

2. The electrodynamic acoustic transducer according to claim 1, wherein $Sb<Sa$ holds where Sa is an area of a maximum surface potential region in which a surface potential of the electret dielectric film is the highest, and Sb is an area of the plurality of segment regions.

3. A condenser microphone comprising:

the electrodynamic acoustic transducer according to claim 1.

4. Condenser headphones comprising:

the electrodynamic acoustic transducer according to claim 1.

5. An electrodynamic acoustic transducer according to claim 1, wherein the fixed pole includes sound holes penetrating therethrough, and the electret dielectric film is integrally formed on the surface of the fixed pole facing the diaphragm.

6. An electrodynamic acoustic transducer according to claim 1, further comprising an insulating spacer ring arranged between the diaphragm and the fixed pole, and a diaphragm ring arranged on one side of the diaphragm opposite to the insulating spacer.

7. An electrodynamic acoustic transducer according to claim 1, wherein the diaphragm facing the electret dielectric film having the plurality of segment regions includes a plurality of sub-vibration regions facing the respective segment regions.

8. An electrodynamic acoustic transducer according to claim 1, wherein the non-polarized regions include a first region having a ring shape between the center region and the circumferential regions, a second region having a ring shape with a radius greater than that of the first region and surrounding the circumferential regions, and a plurality of spoke regions extending radially from the first region to the second region and separating the circumferential regions from each other.

* * * * *